US009057524B2

(12) United States Patent
Jordan et al.

(10) Patent No.: US 9,057,524 B2
(45) Date of Patent: Jun. 16, 2015

(54) SHIELDING WALL FOR A FUEL SUPPLY DUCT IN A TURBINE ENGINE

(75) Inventors: Karsten Jordan, Moers (DE); Tobias Krieger, Duisburg (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 797 days.

(21) Appl. No.: 13/255,117

(22) PCT Filed: Mar. 11, 2010

(86) PCT No.: PCT/EP2010/053060

§ 371 (c)(1), (2), (4) Date: Sep. 7, 2011

(87) PCT Pub. No.: WO2010/121864

PCT Pub. Date: Oct. 28, 2010

(65) Prior Publication Data

US 2011/0314826 A1 Dec. 29, 2011

(30) Foreign Application Priority Data

Mar. 18, 2009 (EP) ..... 09155441

(51) Int. Cl.
*F23R 3/28* (2006.01)

(52) U.S. Cl.
CPC ..... *F23R 3/283* (2013.01); *F23D 2211/00* (2013.01); *F23D 2900/00018* (2013.01)

(58) Field of Classification Search
CPC ..... F23R 3/283; F23D 2211/00; F23D 2900/00018
USPC ..... 60/740, 742, 741, 737, 734
See application file for complete search history.

(56) References Cited

U.S. PATENT DOCUMENTS

| | | | | |
|---|---|---|---|---|
| 5,423,173 | A * | 6/1995 | Lemon et al. | 60/776 |
| 5,761,907 | A * | 6/1998 | Pelletier et al. | 60/740 |
| 6,543,235 | B1 * | 4/2003 | Crocker et al. | 60/776 |
| 6,761,035 | B1 * | 7/2004 | Mueller | 60/800 |
| 6,823,677 | B2 * | 11/2004 | Prociw et al. | 60/800 |
| 2008/0066720 | A1 * | 3/2008 | Piper et al. | 123/470 |
| 2009/0044538 | A1 * | 2/2009 | Pelletier et al. | 60/740 |

FOREIGN PATENT DOCUMENTS

| | | | |
|---|---|---|---|
| CN | 1265455 | A | 9/2000 |
| CN | 1275692 | A | 12/2000 |
| CN | 1818527 | A | 8/2006 |
| EP | 0276696 | A2 | 8/1988 |
| EP | 0580683 | B1 | 11/1995 |
| RU | 2156405 | C2 | 9/2000 |
| WO | WO 0101041 | A1 | 1/2001 |

* cited by examiner

*Primary Examiner* — Phutthiwat Wongwian
*Assistant Examiner* — Carlos A Rivera

(57) ABSTRACT

A burner assembly for a firing system for firing fluidic fuels is provided. The burner assembly has a burner hub, an air inlet channel and a fuel inlet channel, wherein the fuel inlet channel is at least partially designed in the burner hub. A screening wall is arranged in the fuel inlet channel. The screening wall is spaced apart from a wall of the fuel inlet channel so that an intermediate space is formed between the wall of the fuel inlet channel and the screening wall. A sleeve is equipped with at least one radial positioning means that ensures a clearance of the sleeve from the wall of the fuel inlet channel. The at least one radial positioning means of the sleeve is designed as a positioning projection arranged in a circular manner, protruding out radially.

9 Claims, 4 Drawing Sheets

SHIELDING WALL FOR A FUEL SUPPLY DUCT IN A TURBINE ENGINE

CROSS REFERENCE TO RELATED APPLICATIONS

This application is the US National Stage of International Application No. PCT/EP2010/053060 filed Mar. 11, 2010, and claims the benefit thereof. The International Application claims the benefits of European Patent Application No. 09155441.0 EP filed Mar. 18, 2009. All of the applications are incorporated by reference herein in their entirety.

FIELD OF INVENTION

The invention relates to a burner arrangement for firing fluidic fuels and in particular a burner arrangement for a gas turbine installation.

BACKGROUND OF INVENTION

Burner arrangements for firing fluidic fuels are used inter alia to operate gas turbines in power plants and other large machine applications. What are known as dual fuel burners are used in particular here, being provided optionally or combined to fire liquid and gaseous fuels, for example natural gas and fuel oil.

The burner arrangements have correspondingly large dimensions and feature a complex structure with a number of fuel supply ducts. Thus for example a centrally disposed smaller dimensioned pilot burner with its own fuel supply and air supply is frequently used to stabilize the flame of a large main burner, which is disposed around the pilot burner. The large main burner is mainly operated in lean mixture mode with excess oxygen to achieve more favorable emission values. However lean mixture mode means that the flame of the main burner is subject, at least in certain operating states, to fluctuations which are compensated for by a constantly igniting action of the pilot burner. Such a burner arrangement is set out for example in EP 0 580 683 B1.

One challenge with such burners is the mechanical stress resulting due to irregular thermal distribution in the walls of the metal housing, known as the hub, in which the annular supply ducts of the gas and oil energy carriers are disposed relatively close to one another. An annular gas chamber feeds the main burner on the input side in relation to the flow direction of the incoming air upstream of what are known as the swirl blades which swirl and mix the air flow with the combustion gas or through the swirl blades. An oil supply is also present, being generally disposed closer to the burner output than the gas supply. It comprises an annular oil chamber and an oil supply duct leading to the annular chamber, said duct being disposed in the hub wall between the annular gas chamber and the pilot burner.

Since gas is less dense than oil, it takes up a larger cross section, with the result that the dimensions of the gas supply are much larger than those of the oil supply. The part of the burner hub with the gas supply therefore has a larger outer surface facing the air duct than the oil supply. The air supply is effected with precompressed air, which has passed through a compressor, with the result that due to compression said supplied air has a temperature that is already above 400° C. The region of the burner hub with the gas supply is therefore quickly heated to a temperature in the region of above 400° C. and remains at this operating temperature. The oil supply duct leading to the annular oil chamber in contrast is further away from the hot air supply duct so that the oil in the oil supply duct is barely heated and therefore only has a temperature of around 50° C.

Since on the one hand the burner hub is significantly heated in the region of the annular gas chamber and on the other hand the adjacent oil supply duct is much cooler, the wall between the annular gas chamber and the oil supply duct is subject to a large temperature gradient. The temperature gradient causes thermal stress which shortens the service life of such burner hubs and makes it necessary to use a high-quality material with the costs this entails. Such stresses also occur in other regions where a cold fuel is carried through a hot hub region.

SUMMARY OF INVENTION

An object of the present invention is to reduce thermally induced stresses in the burner hub of the burner arrangement.

This object is achieved by a burner arrangement as claimed in the independent claim. The dependent claims contain advantageous embodiments of the invention.

A burner arrangement for a firing installation for firing fluidic fuels comprises a burner hub, at least one air supply duct and at least one fuel supply duct for each type of fuel, the at least one fuel supply duct being configured at least partially in the burner hub. Disposed in at least one fuel supply duct is a shielding wall, which is at a distance from the wall of the fuel supply duct, so that an intermediate space that is not part of the flow path of the fuel flowing through the fuel supply duct is formed between the wall of the fuel supply duct and the shielding wall. The shielding wall is formed by a sleeve introduced into the fuel supply duct. To ensure the correct radial position of the sleeve in the fuel supply duct, it is equipped with at least one radial positioning means, which ensures a gap between the sleeve and the wall of the fuel supply duct, it being possible to select the gap in particular in respect of the maximum permitted heat transfer rate. Restrictions result here however from the space available in the hub. The at least one radial positioning means of the sleeve is embodied as a positioning projection that is disposed to run in a circle and projects radially outward.

In the inventive burner arrangement the intermediate space forms a poor heat-conducting region compared with the surrounding metal of the burner hub, thermally insulating the metal of the hub from the flowing fuel and thereby limiting the exchange of heat between the fuel and the burner hub. In particular the sleeve can feature at least one positioning projection respectively running in a circle in the region of its two ends. This makes the alignment of the sleeve apparatus more reliable and the natural vibrations that may occur due to the clearance gaps in the fuel flow are excluded.

The at least one positioning projection of the sleeve can further feature an annular groove, which is in particular advantageous if the positioning projection is located in the region of a connection point between the fuel supply duct and a fuel supply pipe. The annular groove then makes it possible when welding or soldering the fuel supply pipe to the fuel supply duct to avoid permanently welding or permanently soldering the positioning projection to the fuel supply duct and/or the fuel supply pipe.

The sleeve can also be equipped with at least one axial positioning means, which interacts with at least one axial positioning means present in the fuel supply duct to position the sleeve axially. This allows axial positioning of the sleeve without a material-fit connection. There may in particular be an axial clearance here between the axial positioning means of the sleeve and the axial positioning means in the fuel supply duct, allowing thermal expansion of the sleeve in an axial direction without generating stresses.

In one structurally simple embodiment the axial positioning means of the sleeve can be configured as at least one guide edge on an end surface of the positioning projection. The axial positioning means in the fuel supply duct is then embodied as a counter guide edge.

BRIEF DESCRIPTION OF THE DRAWINGS

Further features, properties and advantages of the invention will emerge from the description which follows of an exemplary embodiment with reference to the accompanying figures, in which.

DETAILED DESCRIPTION OF INVENTION

Figure 1:
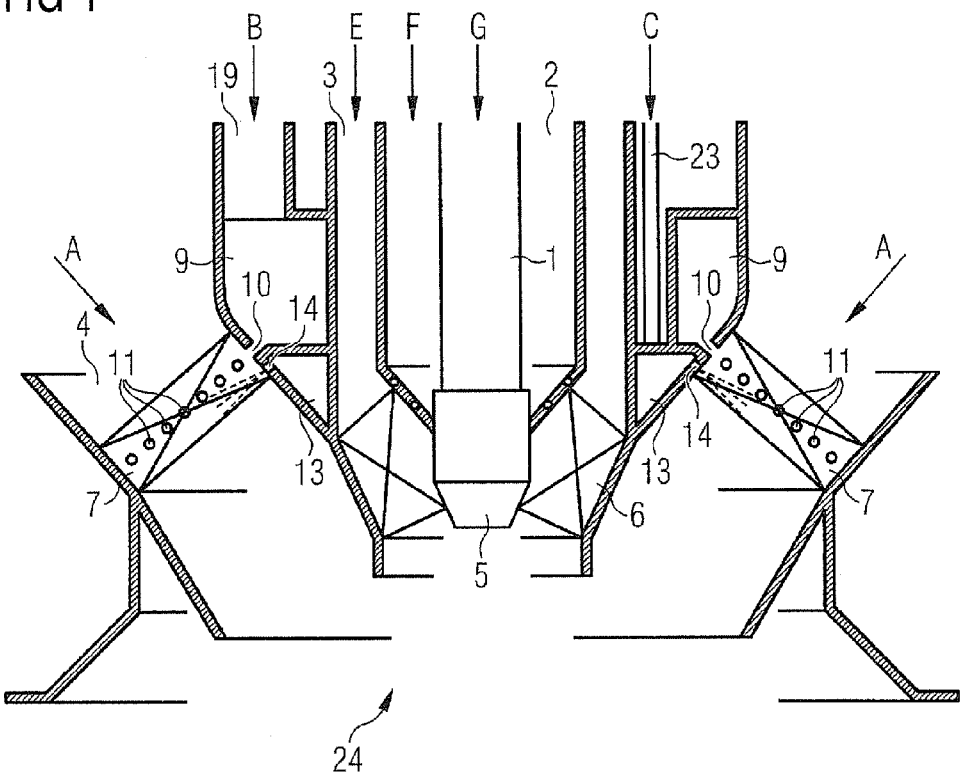
FIG 1 Prior Art
FIG. 1 shows a known burner arrangement.

FIG. 1 shows a burner arrangement according to the prior art, which can optionally be used in conjunction with a number of arrangements of the same type, for example in the combustion chamber of a gas turbine installation.

It consists of an inner part, the pilot burner system, and an outer part lying concentric thereto, the main burner system. Both systems are suitable for operation with gaseous and/or liquid fuels in any combination. The pilot burner system comprises a central oil supply 1 (medium G) with an oil nozzle 5 disposed at its end and an inner gas supply duct 2 (medium F) disposed concentrically around the central oil supply 1. This in turn is surrounded by an inner air supply duct 3 (medium E) disposed concentrically around the axis of the burner. A suitable ignition system, for which many possible embodiments are known, can be disposed in or on the inner air supply duct 3. This is therefore not illustrated here. The inner air supply duct 3 features a swirl blade system 6 in its end region. The pilot burner system can be operated in a manner known per se, in other words predominantly as a diffusion burner. Its task is to maintain the main burner in stable burn mode since it is generally operated with a lean mixture to reduce harmful emissions, thus requiring stabilization of its flame by means of a diffusion flame or a flame based on a less lean mixture.

The main burner system features an outer annular air supply duct system 4 disposed concentrically to the pilot burner system and running obliquely to this. This annular air supply duct system 4 is also provided with a swirl blade system 7. The swirl blade system 7 consists of hollow blades with outlet nozzles 11 in the flow cross section of the annular air supply duct system 4 (medium A). These are fed from a gas supply line 19 and an annular gas duct 9 through openings 10. The burner also features an oil supply line 23, which opens into an annular oil duct 13, which for its part features outlet nozzles 14 in the region or downstream of the swirl blade system 7.

Figure 2:
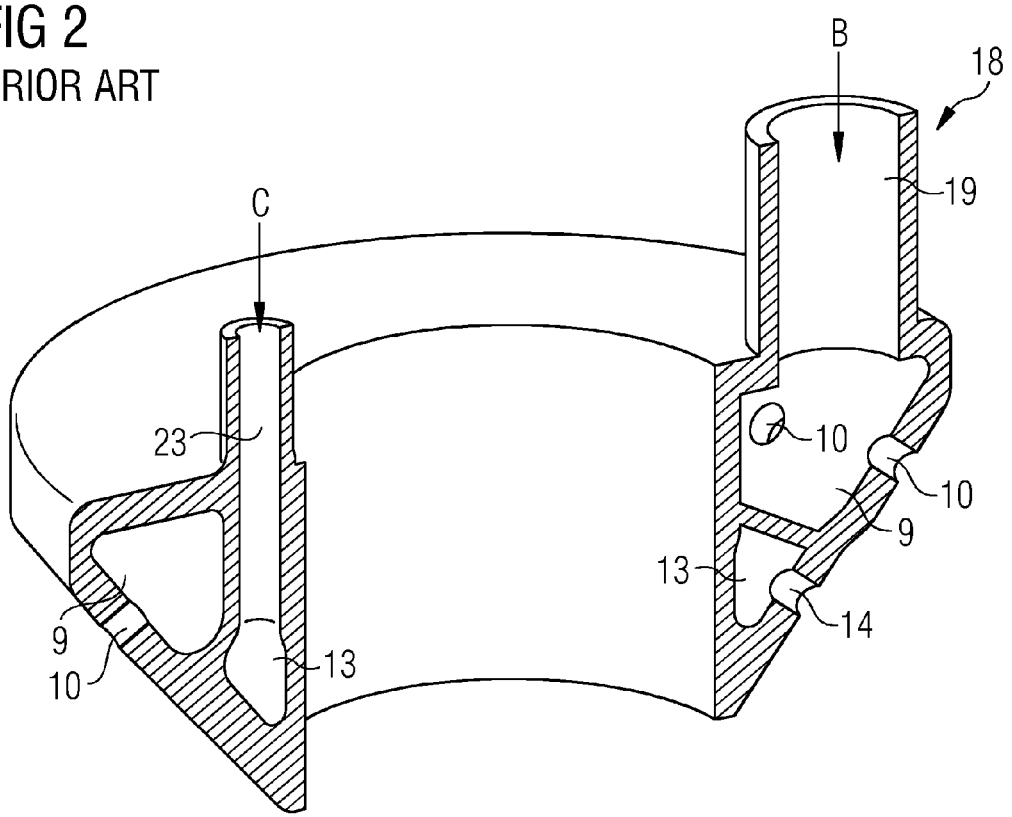
FIG 2 PRIOR ART
FIG. 2 shows a known embodiment of the burner hub of a burner arrangement.

FIG. 2 shows an embodiment of the burner hub 18 of a burner arrangement according to the prior art in cross section.

The burner hub 18 features welded cast plugs not shown) in the manner of a cast part configured as a single piece, used to seal the auxiliary openings that served for the removal of the molded cores.

Disposed in the burner hub 18 are an annular gas chamber 9 and an annular oil chamber 13. On the outward facing and tapering side surface of the burner hub 18 the annular chambers 9 and 13 each have a plurality of outlet openings 10 and 14, through which the respective fuel (medium B or as the case may be medium C in FIG. 1) are sprayed out into the combustion chamber 24 (see FIG. 1).

Figure 3:
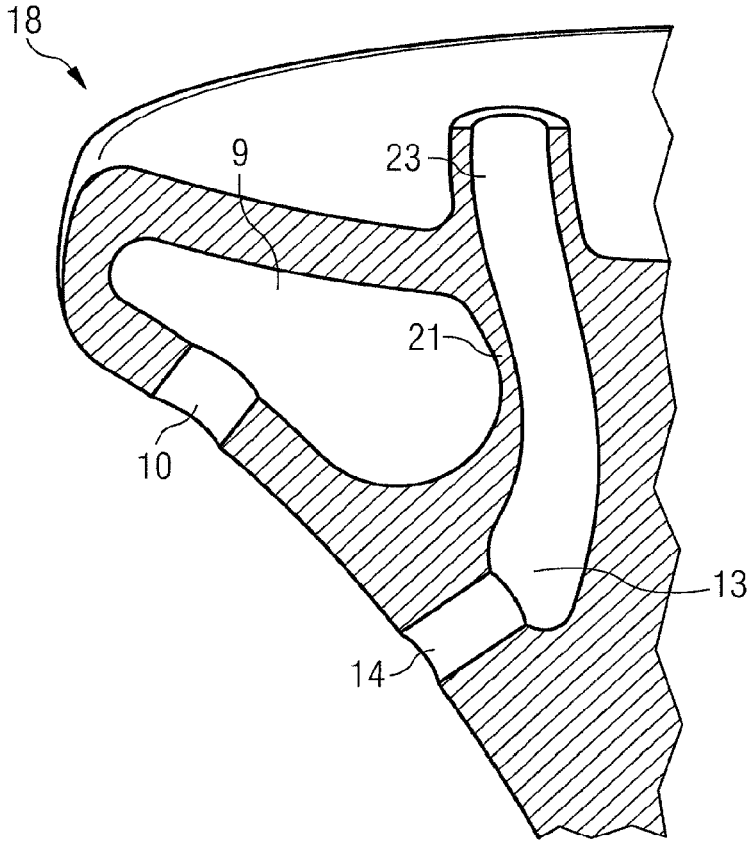
FIG 3 PRIOR ART
FIG. 3 shows a schematically exaggerated consequence of the thermally induced stress in the burner hub according to the prior art from FIG. 2.

FIG. 3 shows a schematically exaggerated consequence of the thermally induced stresses in the burner hub according to the prior art from FIG. 2. The stresses cause the wall 21 between the annular gas chamber 9 and the oil supply line 23 to become deformed. This deformation of the metal cast and/or welded burner hub 18 results from the temperature gradient in the wall between the oil supply duct 23, through which the oil flows at a temperature of approx. 50° C., and the annular gas chamber 9, which because it is heated by the compressor air in the air supply duct 4 (medium A in FIG. 1) is heated to around 420° C.

Figure 4:
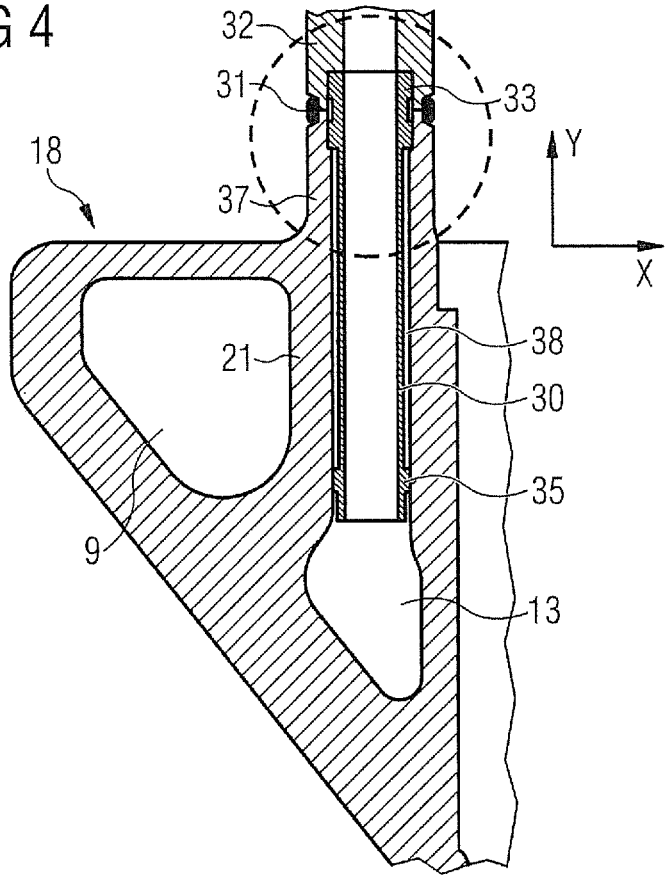
FIG. 4 shows a cross-sectional view of a preferred embodiment of the inventive burner arrangement.

FIG. 4 shows a segment of a cross section through an embodiment of the inventive burner arrangement. The burner arrangement comprises a burner hub 18, in which are disposed an annular gas chamber 9 with a gas supply duct 19 (not shown in FIG. 4) and an annular oil chamber 13 with an oil supply duct 23. The basic structure of the burner arrangement corresponds to the structure described with reference to FIGS. 1 and 2. Therefore only the differences in respect of the burner structure described in FIGS. 1 and 2 are described.

In the inventive burner arrangement a shielding wall 30 is disposed in the oil supply duct 23 such that an intermediate space 38 is formed between the wall between the annular gas chamber 9 and the oil supply line 23 on the one hand and the shielding wall 30 on the other hand. This intermediate space 38 insulates the flow path of the oil formed by the inner surface of the shielding wall 30 thermally from the wall 21 between the annular gas chamber 9 and the oil supply line 23, since the medium present in the intermediate space, for example air or non-flowing or barely flowing oil, has a very much lower heat conductivity than the metal of the burner hub 18. The heat conductivity of air is for example 0.023 W/mK and that of oil around 0.15 W/mK (at room temperature). The heat conductivity of metals is two to three orders of magnitude higher in contrast. The intermediate space 38 can therefore be seen as an adiabatically active thermal shield. The dimension of the gap s between the wall 21 and the shielding wall 30 can be used structurally to set a desired heat transfer rate.

The shielding wall is realized in the form of a sleeve 30 inserted into the oil supply duct 23, which prevents direct contact between the cold oil flowing along the flow path in the oil supply duct 23 and the wall 21 between the annular gas chamber 9 and the oil supply line 23. The outer diameter of the sleeve 30 is dimensioned smaller by a predefined amount than the inner diameter of the oil supply duct 23, so that an intermediate space 38 is formed between the inserted sleeve 30 and the wall 21, in which a medium is present with a much lower heat conductivity than the metal of the burner hub 18. The oil flowing through the sleeve 30 disposed at a distance from the wall 21 therefore barely causes the wall 21 to be cooled, with the result that the temperature gradient between the surface on the side of the annular gas chamber and the surface of the wall 21 on the side of the oil duct becomes smaller. Therefore much fewer mechanical stresses occur than in the prior art.

Oil itself can be used in the simplest instance as a suitable medium in the intermediate space 38, as long as there is no risk of ignition, as it is then not necessary to seal the intermediate space 38 off from the flow path of the oil.

Figure 5:
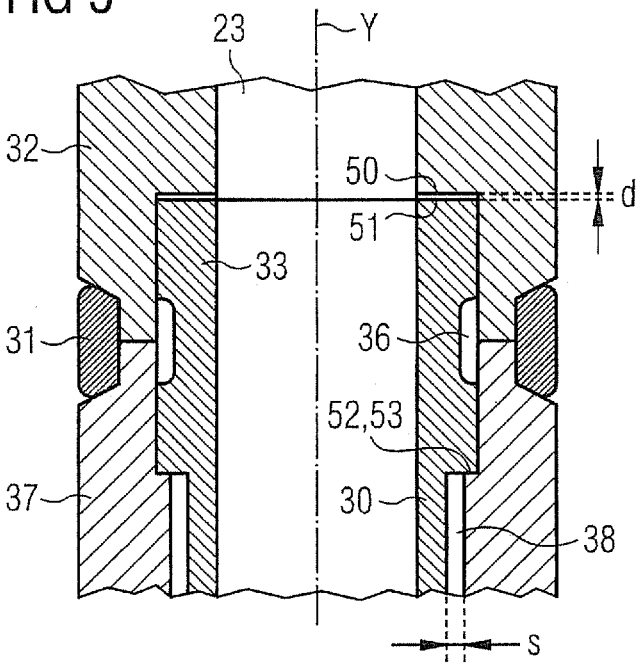
FIG. 5 shows an enlarged partial cross-sectional view from FIG. 4.

In order to be able to mount the sleeve 30 simply in the oil supply duct 23 of the burner hub 18, it is configured as a sleeve 30 that can be inserted into an opening in a tubular segment 37 of the oil supply duct 23. To this end the sleeve 30 has at its upstream end an annular positioning projection 33, preferably running in a circle, which serves as a spacer to center the sleeve body radially in the hollow space 23 and at the same time has the function of a guide edge 53, which abuts against a complementary counter guide edge 52 present in the region of the opening of the tubular projection 37 and thus defines the position of the sleeve 30 in an axial direction. For clarification FIG. 5 shows an enlarged partial cross sectional view of the tubular segment 37 of the oil supply duct 23 and the sleeve 30 introduced therein.

At its upstream end the sleeve 30 has a positioning projection 33 with an annular groove 36. The annular groove 36 is located, when the sleeve 30 is inserted into the oil supply duct 23, at the level of the plane in which the opening of the tubular segment 37 is located. Thus when the tubular segment 37 is welded to an oil supply pipe 32, the weld seam 31 is located in the region of the annular groove 36, so that when the two pipe ends 30 are connected, the positioning projection 33, and therefore the sleeve 30, is not permanently welded or burned into place.

The positioning projection 33 is disposed in a widened milled groove in the tubular segment 37 and a corresponding milled groove in the oil supply line pipe 32. Like the milled groove in the tubular segment 37 the milled groove in the oil supply line pipe 32 also has a counter guide edge 50, which interacts with a guide edge 51 of the positioning projection 33. This means that the sleeve 30 is not only centered by the positioning projection 33 in the oil supply duct 23 but it is also secured in the direction of the longitudinal axis Y.

The described manner of positioning may already be adequate in the context of the invention but the present embodiment features a further positioning projection 35 (FIG. 4), which is disposed in proximity to the downstream end of the sleeve 30. It can effectively counter for example any natural vibrations that may occur in the sleeve 30. The positioning projection 35 disposed at the downstream end of the sleeve 30 is also preferably embodied as an annular projection running in a circle and its preferably cylindrically embodied outer diameter extends to the wall of the hollow space 38, so that it also helps to center the sleeve 30.

All the positioning projections 33, 35 preferably feature a diameter that is dimensioned so that there is a sufficient gap between the walls of the hollow space 30 and the cylindrical outer surfaces of the positioning projections to compensate for different thermal expansions. This means that on the one hand the sleeve 30 is positioned accurately enough in a radial direction and on the other hand that it is never trapped during operation. The stresses that also occur in the burner hub 18 as a result of trapping are thus effectively avoided.

According to the invention the thermal expansion of the sleeve 30 in an axial direction Y is also embodied to be free from such trapping as it would produce stress. To this end the positioning projection 33 in the milled grooves of the tubular segment 37 and the oil supply line pipe 32 is dimensioned so that a predefined clearance d is present between the counter guide edge 50 in the milled groove of the oil supply line pipe 32 and the corresponding guide edge 51 of the positioning projection 33, allowing thermal expansion of the sleeve in an axial direction without stresses building up in an axial direction Y as a result.

The sleeve 30 can be mounted in the inventive burner arrangement by introducing it into the fuel supply duct 23 through the opening of the tubular segment 37 of the fuel supply duct 23 to be connected to a fuel supply pipe 32 until the guide edge 53 of the positioning projection 33 comes up against the counter guide edge 52 in the milled groove of the tubular segment 37. The fuel supply pipe 32 is then positioned on the upstream end of the tubular segment 37 and connected with the aid of a welding procedure to the tubular segment 37, the annular groove 36 preventing permanent welding of the sleeve to the fuel supply pipe 32 and/or to the tubular segment 37.

With the described embodiment of the sleeve 30 and of the milled grooves of the tubular segment 37 and the oil supply line pipe 32 it is possible to prevent both axial and radial stresses due to trapping of the sleeve 30.

Although in the context of the exemplary embodiment the invention has been described with reference to a specific oil supply duct, it can also be applied in other fuel supply ducts. Also the sleeve does not have to have a round cross section but can also have an angular cross section.

The invention claimed is:

1. A burner arrangement for a firing installation for firing fluidic fuels, comprising:

a burner hub;

at least one air supply duct;

at least one fuel supply pipe;

at least one fuel supply duct which is configured at least partially in the burner hub;

wherein the at least one fuel supply duct comprises a shielding wall, which is at a distance from a wall of the at least one fuel supply duct, so that an intermediate space that is not part of a flow path of a fuel flowing through the at least one fuel supply duct is formed between the wall of the at least one fuel supply duct and the shielding wall, wherein the shielding wall is formed by a sleeve introduced into the at least one fuel supply duct, wherein the sleeve comprises at least one radial positioning device, which ensures a gap between the sleeve and the wall of the at least one fuel supply duct, and wherein the at least one radial positioning device of the sleeve is a circumferential and radially outward projecting positioning projection, wherein the at least one radial positioning projection of the sleeve comprises an annular groove, wherein the annular groove is spaced apart from the intermediate space and axially aligned with a connection point between said at least one fuel supply pipe and said at least one fuel supply duct.

2. The burner arrangement as claimed in claim 1, wherein the sleeve features two positioning projections, each positioning projection being located at an end region of the sleeve, and wherein the position projections each feature an annular groove.

3. The burner arrangement as claimed in claim 2, wherein the sleeve includes at least one axial positioning device.

4. The burner arrangement as claimed in claim 3, wherein the sleeve includes several axial positioning devices which interact with axial positioning devices of the at least one fuel supply duct in order to position the sleeve axially.

5. The burner arrangement as claimed in claim 4, wherein an axial clearance is present between the axial positioning devices of the sleeve and the axial positioning devices of the at least one fuel supply duct.

6. The burner arrangement as claimed in claim 4, wherein the axial positioning devices of the sleeve are configured as a guide edge on an end surface of the positioning projections, and wherein the axial positioning devices of the at least one fuel supply duct are embodied as counter guide edges.

7. The burner arrangement as claimed in claim 5, wherein the axial positioning devices of the sleeve are configured as a guide edge on an end surface of the positioning projections, and wherein the axial positioning devices of the at least one fuel supply duct are embodied as counter guide edges.

8. A turbine engine comprising the burner arrangement of claim 1.

9. The burner arrangement as claimed in claim 1, wherein the annular groove is effective, when welding or soldering the fuel supply pipe to the fuel supply duct, to avoid permanently welding or permanently soldering the at least one radial positioning projection to the fuel supply duct and/or the fuel supply pipe.

* * * * *